US007378606B2

(12) United States Patent
Lee et al.

(10) Patent No.: US 7,378,606 B2
(45) Date of Patent: May 27, 2008

(54) KEYPAD AND KEYPAD ASSEMBLY

(75) Inventors: Joo-Hoon Lee, Yongin-si (KR); Sun-Tae Jung, Anyang-si (KR); Kyoung-Youm Kim, Seoul (KR); Byung-Duck Cho, Seoul (KR); Dong-Hoon Jang, Suwon-si (KR)

(73) Assignee: Samsung Electronics Co., Ltd., Maetan-Dong, Yeong Tong-Gu, Suwon-Si, Gyeonggi-Do (KR)

( * ) Notice: Subject to any disclaimer, the term of this patent is extended or adjusted under 35 U.S.C. 154(b) by 0 days.

(21) Appl. No.: 11/327,029

(22) Filed: Jan. 6, 2006

(65) Prior Publication Data

US 2006/0260923 A1 Nov. 23, 2006

(30) Foreign Application Priority Data

May 19, 2005 (KR) ..... 10-2005-0042035
Jul. 15, 2005 (KR) ..... 10-2005-0064351

(51) Int. Cl.
*H01H 9/00* (2006.01)

(52) U.S. Cl. ..... 200/314; 200/310; 200/313

(58) Field of Classification Search ..... 200/310–314, 200/317

See application file for complete search history.

(56) References Cited

U.S. PATENT DOCUMENTS

| | | | | |
|---|---|---|---|---|
| 2,886,911 | A | 5/1959 | Hardesty | 40/130 |
| 4,343,975 | A | 8/1982 | Sado | 200/314 |
| 5,128,842 | A | 7/1992 | Kenmochi | 362/95 |
| 5,491,313 | A | 2/1996 | Bartley et al. | 200/310 |
| 5,568,367 | A | 10/1996 | Park | 362/109 |
| 5,573,107 | A | 11/1996 | Nakano et al. | 200/314 |
| 5,766,981 | A | 6/1998 | Thornton et al. | 438/36 |
| 6,644,822 | B2 * | 11/2003 | Kumagai | 362/26 |
| 6,860,612 | B2 * | 3/2005 | Chiang et al. | 362/29 |
| 6,977,352 | B2 * | 12/2005 | Oosawa | 200/314 |
| 7,014,377 | B2 * | 3/2006 | Yamauchi | 400/472 |
| 7,188,989 | B2 | 3/2007 | Miyashita | 362/621 |
| 7,250,937 | B2 | 7/2007 | Takagi | 345/168 |
| 2003/0095398 | A1 * | 5/2003 | Parker et al. | 362/29 |
| 2004/0018796 | A1 | 1/2004 | Hamada | |

FOREIGN PATENT DOCUMENTS

| | | | |
|---|---|---|---|
| EP | 0552497 | * | 10/1997 |
| EP | 0552497 B1 | | 10/1997 |
| JP | 61-202549 | | 9/1986 |
| JP | 03-257728 | | 11/1991 |
| JP | 04-022023 | | 1/1992 |
| JP | 2001-167655 | | 6/2001 |
| JP | 2002-300258 | | 10/2002 |
| JP | 2002300258 | * | 10/2002 |
| JP | 2003-178639 | | 6/2003 |
| JP | 2003-308752 | | 10/2003 |
| JP | 2004-200093 | | 7/2004 |
| KR | 2005-0057807 | | 6/2005 |

* cited by examiner

*Primary Examiner*—Elvin Enad
*Assistant Examiner*—Lheiren Mae A. Anglo
(74) *Attorney, Agent, or Firm*—Cha & Reiter, LLC

(57) ABSTRACT

A keypad includes a light guide panel, the interior of which light propagates through, a film positioned on the upper surface of the light guide panel and having at least one key button positioned on the upper surface thereof, and at least one reflective pattern fixedly positioned with respect to the light guide panel to reflect a part of the light, which propagates through the interior of the light guide panel, towards the key button.

26 Claims, 4 Drawing Sheets

KEYPAD AND KEYPAD ASSEMBLY

CLAIM OF PRIORITY

This application claims priority to an application entitled "Keypad and Keypad Assembly," filed with the Korean Intellectual Property Office on Jul. 15, 2005 and assigned Serial No. 2005-64351, and an application entitled "Key Pad and Key Pad Assembly," filed with the Korean Intellectual Property Office on May 19, 2005 and assigned Serial No. 2005-42035, the contents of both being incorporated herein by reference.

BACKGROUND OF THE INVENTION

1. Field of the Invention

The present invention relates to a keypad used in a portable terminal, and more particularly to a keypad and a keypad assembly having a light guide panel.

2. Description of the Related Art

A keypad used in a portable terminal typically includes an elastic pad plate, a plurality of key buttons formed on the upper surface of the elastic pad with characters printed on the upper surface thereof, respectively, and a plurality of protrusions (or actuators) formed on the lower surface of the elastic pad. This type of portable terminal normally has about 15–20 light emitting devices serving as a back light of the keypad.

FIG. 1 is a sectional view showing a keypad assembly according to the prior art. As shown, the keypad assembly 100 includes a keypad 110, a switch board 150, and a plurality of light emitting diodes(LEDs) 170.

The keypad 110 includes an elastic pad 120 having the shape of a plate, a plurality of key buttons 140 formed on the upper surface 122 of the elastic pad 120 with characters, numbers, etc., printed on the upper surface thereof, respectively, and a plurality of protrusions 130 formed on the lower surface 124 of the elastic pad 120, which is opposite to the upper surface 122 of the elastic pad 120. Each of the protrusions 130 is aligned with the center portion of the corresponding key button 140. The elastic pad 120 has a plurality of grooves 126 formed on the lower surface 124 thereof. The grooves 126 are positioned around the respective protrusions 130 to prevent the LEDs 170 from interfering with the protrusions 130.

The switch board 150 has a plate-shaped PCB (Printed Circuit Board) 155 and a plurality of switches 160 formed on the upper surface of the PCB 155 facing the keypad 110. Each switch 160 is comprised of a conductive contact member 162 and a conductive dome 164 covering the contact member 162 completely.

The plurality of LEDs 170 are mounted on the upper surface of the PCB 155, and each LED 170 is positioned to be covered by the corresponding groove 126 of the elastic pad 120.

When the user presses one of the key buttons 140, the portion of the keypad 110 positioned beneath the pressed key button 140 deforms towards the switch board 150. As a result, one of the protrusions 130 corresponding to the deformed portion presses the corresponding dome 164, thus providing an electrical contact with the corresponding contact member 162.

Due to the operation of the switches 160 in the vicinity, the LEDs 170 must not be positioned beneath the corresponding key buttons 140. Light outputted from the respective LEDs 170 passes through the elastic pad 120 and illuminates the respective key buttons 140 at an oblique angle. As a result, the key buttons 140 are dimly illuminated in a non-uniformly fashion. In particular, the center of each key button 140 looks darker, and the periphery thereof looks brighter. If more LEDs are installed to enhance an uniform illumination of the key buttons 140, power consumption and manufacturing cost increase.

SUMMARY OF THE INVENTION

Accordingly, the present invention has been made to solve the above-mentioned problems occurring in the prior art and provides additional advantages, by providing a keypad and a keypad assembly capable of realizing high and uniform brightness, while consuming less power and costing less.

In one embodiment, there is provided a keypad including a light guide panel, the interior of which light propagates through; a film positioned on the upper surface of the light guide panel and having at least one key button positioned on the upper surface thereof; and at least one reflective pattern fixedly positioned with respect to the light guide panel to reflect a part of the light, which propagates through the interior of the light guide panel, towards the key button.

In another embodiment, there is provided a keypad assembly including a keypad having a light guide panel, the interior of which light propagates through, and a film positioned on the upper surface of the light guide panel with at least one key button positioned on the upper surface of the film and a switch board having at least one switch formed on its upper surface, which faces the keypad, wherein as the key button is pressed, the portion of the keypad deformed towards the switch board presses the switch.

In yet another embodiment, there is provided a portable terminal including a switch board having at least one switch positioned on the upper surface thereof; a keypad having a light guide panel with upper, lower, and lateral surfaces; and at least one light emitting device positioned adjacent to at least one of the lateral surfaces of the light guide panel, wherein the keypad includes a film positioned on the upper surface of the light guide panel and having at least one key button positioned on the upper surface thereof and at least one reflective pattern locally formed on the light guide panel to reflect a part of light, which propagates through the interior of the light guide panel, towards the key button.

BRIEF DESCRIPTION OF THE DRAWINGS

The above features, and advantages of the present invention will be more apparent from the following detailed description taken in conjunction with the accompanying drawings, in which.

DETAILED DESCRIPTION

Hereinafter, embodiments of the present invention will be described with reference to the accompanying drawings. For the purposes of clarity and simplicity, a detailed description of known functions and configurations incorporated herein is omitted to avoid making the subject matter of the present invention unclear.

Figure 1:
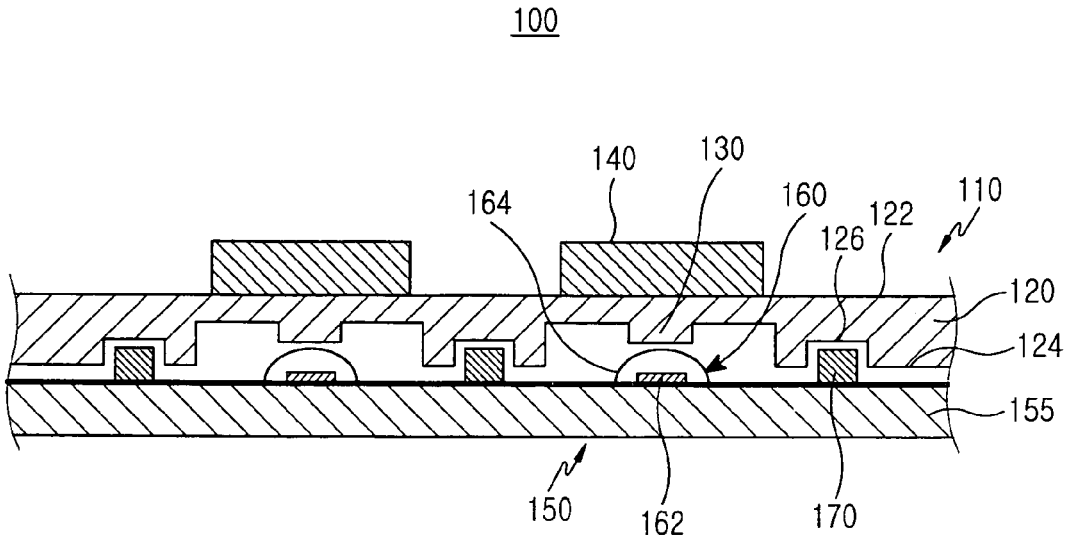
FIG.1 (PRIOR ART)
FIG. 1 is a sectional view showing a keypad assembly according to the prior art.
Figure 2:
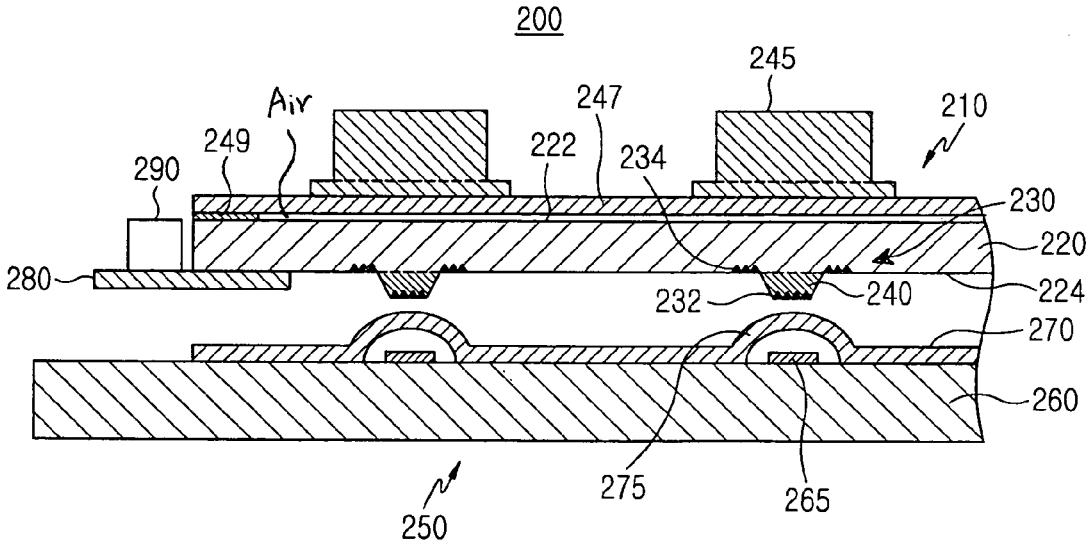
FIG. 2 is a sectional view showing a keypad assembly according to a first embodiment of the present invention.
Figure 3:
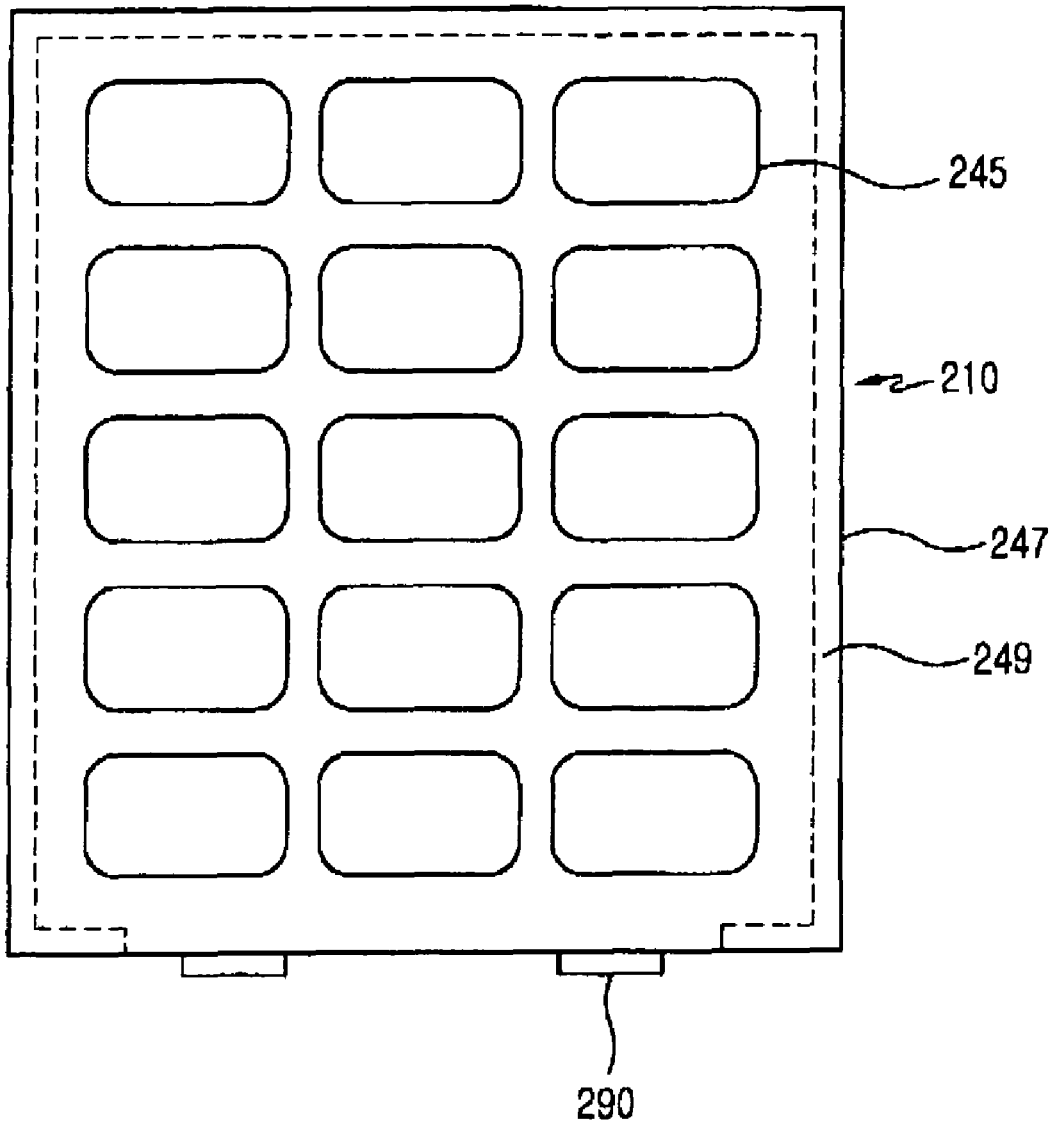
FIG. 3 is a top view briefly showing a part of the keypad assembly shown in FIG. 2.

FIG. 2 is a sectional view showing a keypad assembly according to a first embodiment of the present invention, and FIG. 3 is a top view briefly showing a part of the keypad assembly.

Referring to FIG. 2, the keypad assembly 200 includes a keypad 210, a switch board 250 facing the keypad 210, at least one light emitting device 290, and a second PCB 280.

The keypad 210 includes a light guide panel 220, a film 247, a plurality of key buttons 245, a plurality of protrusions 240, and a plurality of reflective patterns 230 (indicated by solid triangles).

The light guide panel 220 guides light coupled to the interior thereof. The coupled light propagates from a lateral surface of the light guide panel 220 to the opposite lateral surface thereof. The light guide panel 220 may have any shape, such as a square. The light coupled to the interior of the light guide panel 220 propagates into the light guide panel 220 due to a total reflection at the interface between the light guide panel 220 and the external air layer. The light guide panel 220 has elasticity so that the key buttons 245, when pressed, can return to the original position. That is, the light guide panel 220 has self-restoration properties so that it can restore the original shape after deformation and, after the key buttons 245 are operated, returns them to the original position.

Conventional light guide panels are manufactured by injection-molding process using polycarbonate or acryl-based resin which has a high transmittance for visible rays. They have low elastic modulus, poor elastic restoration properties, and high hardness. This makes it difficult to obtain a good click feel when pressing key buttons. Also, when a key button is pressed, adjacent key buttons may be erroneously operated together (interference among key buttons). Further, permanent deformation may easily occur after repeated operation.

Therefore, the light guide panel 220 according to the present invention is made of a highly transparent elastomer material, preferably polyurethane or silicone, which has low hardness, high elastic modulus, excellent elastic restoration properties, and high optical transmittance, in order to provide a good click feel, suppress interference among key buttons 245, and avoid permanent deformation even after repeated operation.

The film 247 is disposed on the upper surface of the light guide panel 220, and it has a plurality of key buttons 245 positioned on the upper surface thereof. The periphery of the film 247 is attached to the periphery of the light guide panel 220 using an adhesion member 249 to bond and maintain an upper air layer between the film 247 and the light guide panel 220. Also, there is a lower air layer beneath the light guide panel 220, and it prevents light, which is supposed to illuminate the key buttons 245, from leaking via the adhesion member 249. Light propagates between the interfaces between the light guide panel 220 and the upper and lower air layers due to total reflection. If the condition of total reflection is not maintained at the interface between the light guide panel 220 and the adhesion member 249, unnecessary leakage of light may occur. The adhesion member 249 is preferably positioned on the periphery of the light guide panel 220 as the rest of light which is not used to illuminate the key buttons 245 reaches the periphery of the light guide panel 220. The film 247 preferably has such surface properties that it is not attached to the upper surface of the light guide panel 220, because, if the center of the film 247 having the key buttons positioned thereon is attached to the upper surface of the light guide panel 220, no air layer can be maintained between the light guide panel 220 and the film 247. To this end, the surface of the film 247 may be roughened or coated with a releasing agent in order to provide the surface with slipperiness. In addition, a portion of the upper surface of the film 247, which has no key button 245 positioned thereon, may be subject to printing to prevent the light from emerging from portions other than the key buttons 245. Note that the printing indicates a silk screen printing process, which is generally used in the conventional keypad process, used to intercept light using black color material etc. in order to prevent the light from leaking to undesired place.

The film 247 may be made of a highly transparent elastomer material, preferably polyurethane or silicone, which has low hardness, high elastic modulus, excellent elastic restoration properties, and high optical transmittance.

When the whole film 247 is attached to the upper surface of the light guide panel 220, the refractive index of the film 247 is set to be lower than that of the light guide panel 220 and the attachment surface (or lower surface) of the film is printed or coated with a layer, which is made of a material having high reflectance, to minimize unnecessary loss of light.

The plurality of key buttons 245 is positioned on the upper surface of the film 247 and have characters, numeral, etc. printed on the upper surface thereof, respectively. Each key button 245 may be attached to the upper surface of the film 247 by a corresponding adhesion member or may be formed as an integrated one piece with the film 247. Each key button 245 may be made of the same material as the film 247 or made of polycarbonate or acryl-based resin. Each key button 245 may have any shape, such as a circular post or elliptical post.

The plurality of protrusions 240 is positioned on the lower surface 224 of the light guide panel 220, which is opposite to the upper surface 222 of the light guide panel 220. The protrusions 240 may be formed in one piece with the light panel 220 using a material identical to or different from that of the light guide panel 220. Alternatively, the protrusions 240 may be separately formed and attached to the lower surface 224 of the light guide panel 220. Each protrusion 240 may have any shape, such as a truncated cone or trapezoidal hexahedron. Each protrusion 240 is aligned under the corresponding key button 245 (in a thickness direction of the keypad assembly 200 or a perpendicular direction to the upper surface of the first PCB 260).

The keypad 210 has a plurality of reflective patterns 230 formed on the lower surface of the light guide panel 220 to reflect a part of light, which propagates into the light guide panel 220, towards the corresponding key buttons 245, respectively. If necessary, each reflective pattern 230 may be formed on the upper surface of the light guide panel 220 or positioned between the light guide panel 220 and the corresponding protrusion 240. Each reflective pattern 230 is formed at and around the protrusion 240 positioned just under the corresponding key button 245 to uniformly illuminate it. In the entire keypad 210, the density or size of reflective patterns positioned closer to the light emitting device 290 is different from that of reflective patterns positioned farther away from the light emitting device 290. This is done in order to uniformly adjust the overall distribution of light quantity emerging from the upper side of the light guide panel 220 regardless of the distance from the light emitting device 290. For example, when the amount of light emerging from positions closer to the light emitting device 290 is larger, the density of reflective patterns closer to the light emitting device 290 is set to be lower. When the amount of light emerging from positions farther away from the light emitting device 290 is smaller, the density of reflective patterns farther away from the light emitting device is set to be higher. In this manner, the distribution of quantity of emergent light, particularly the overall illumination distribution of the key buttons 245 can be uniform and bright.

The central portion 232 of each reflective pattern 230 is formed on the lower surface of the corresponding protrusion 240, and the peripheral portion 234 thereof is formed around the protrusion 240. As shown, light propagating into the light guide panel 220 due to total reflection is incident on the reflective patterns 230. Most light diffuse reflected by the reflective patterns 230 towards a key button 245 cannot satisfy the condition of total reflection (when incident angle is smaller than critical angle) and passes through the film 247 and the corresponding key button 245 to the exterior. In addition, light passing through the reflective patterns 230 without diffuse reflection and a part of the diffuse reflected light satisfying the condition of total reflection, continuously propagate inside the light guide panel 220 while contributing to illuminate other key buttons. In this manner, each reflective pattern 230 causes diffuse reflection and use only a part of incident light for illumination of the corresponding key button 245, and the rest is used for illumination of other key buttons. Furthermore, the reflective patterns 230 provide uniform illumination of the key button 245 by means of diffuse reflection in an arbitrary direction. Preferably, the reflective patterns 230 are formed by scratching or printing.

The switch board 250 includes a first PCB 260 and a dome sheet 270.

The first PCB 260 has a plurality of conductive contact members 265 formed on the upper surface thereof, which constitute switches 265 and 275 together with corresponding domes 275. The switches 265 and 275 are aligned under the corresponding protrusions 240.

The dome sheet 270 is attached to the upper surface of the first PCB 260 and has a plurality of semi-spherical conductive domes 275, which completely cover the corresponding contact members 265.

When the user presses one of the key buttons 245, the portion of the keypad 210 positioned beneath the pressed key button 245 deforms towards the switch board 250. As a result, one of the protrusions 240 corresponding to the deformed portion presses the corresponding dome 275, which then makes electrical contact with the corresponding contact member 265. When the light guide panel 220 is made of an elastomer material, it has a sticky surface and the domes 275 are likely to be attached to the lower surface of the light guide panel 220. Therefore, the surface of each dome 275 may be roughed or coated with a releasing agent in order to provide the surface with slipperiness.

The second PCB 280 is attached to the periphery of the lower surface 224 of the light guide panel 220. The light emitting device 290 is mounted on the upper surface of the second PCB 280 with its light emitting surface facing the lateral surface of the light guide panel 220. Light emerging from the light emitting device 290 is coupled to the interior of the light guide panel 220 via the lateral surface thereof. The second PCB 280 may be made of a conventional flexible PCB (FPCB), and the light emitting device may be a conventional LED.

In the present embodiment, the second PCB 280 may be removed and a peripheral portion of the light guide panel 220 may extend with a slant to the upper surface of the first PCB 260 in the shape of a wedge. The light emitting device 290 is then mounted on the upper surface of the first PCB 260.

Alternatively, the second PCB 280 may be removed and a peripheral portion of the light guide panel 220 may be bent so that it extends to the upper surface of the first PCB 260. The light emitting device 290 is then mounted on the upper surface of the first PCB 260.

Figure 4:
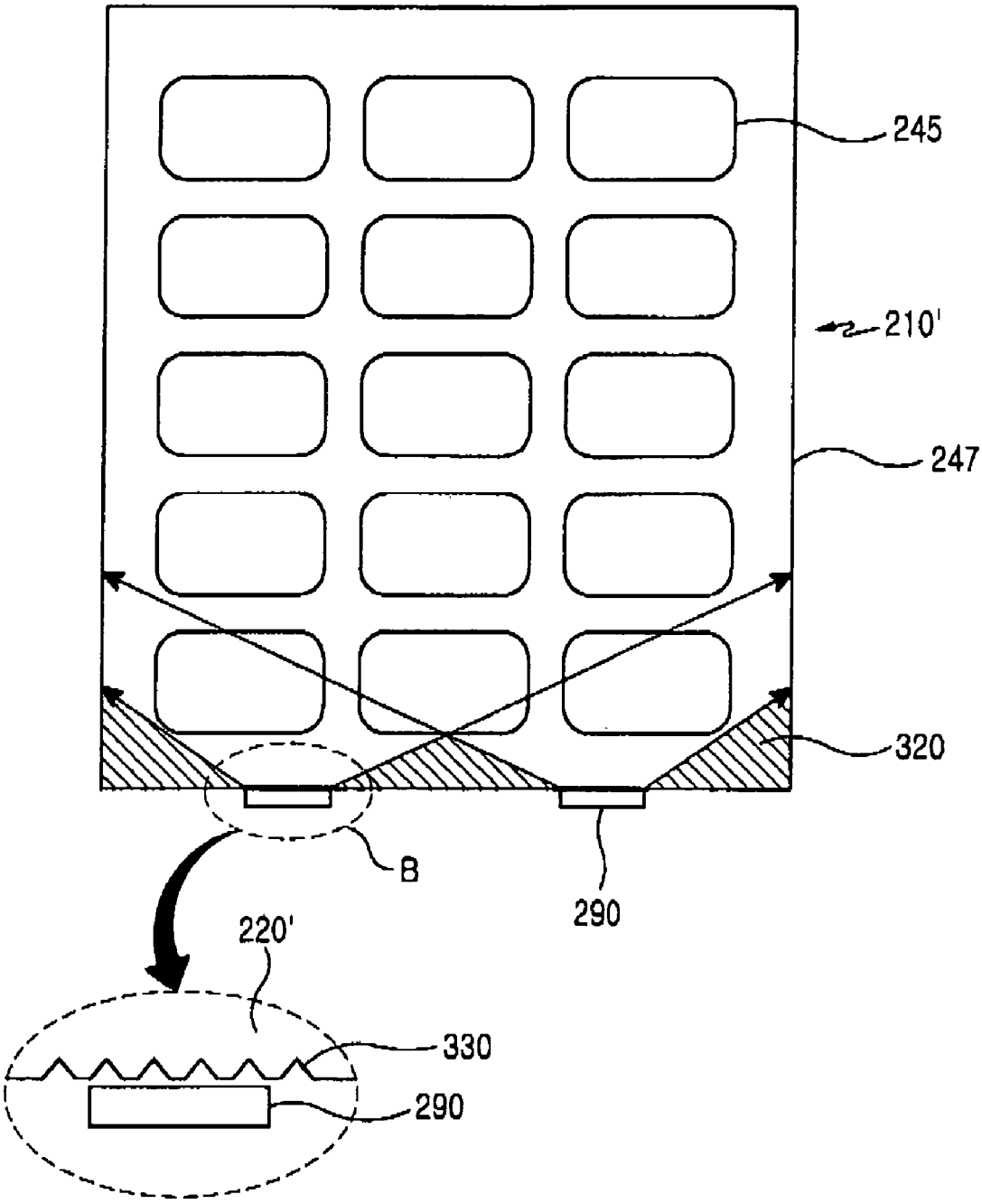
FIG. 4 is a top view briefly showing a part of a keypad assembly according to a second embodiment of the present invention.
Figure 5:
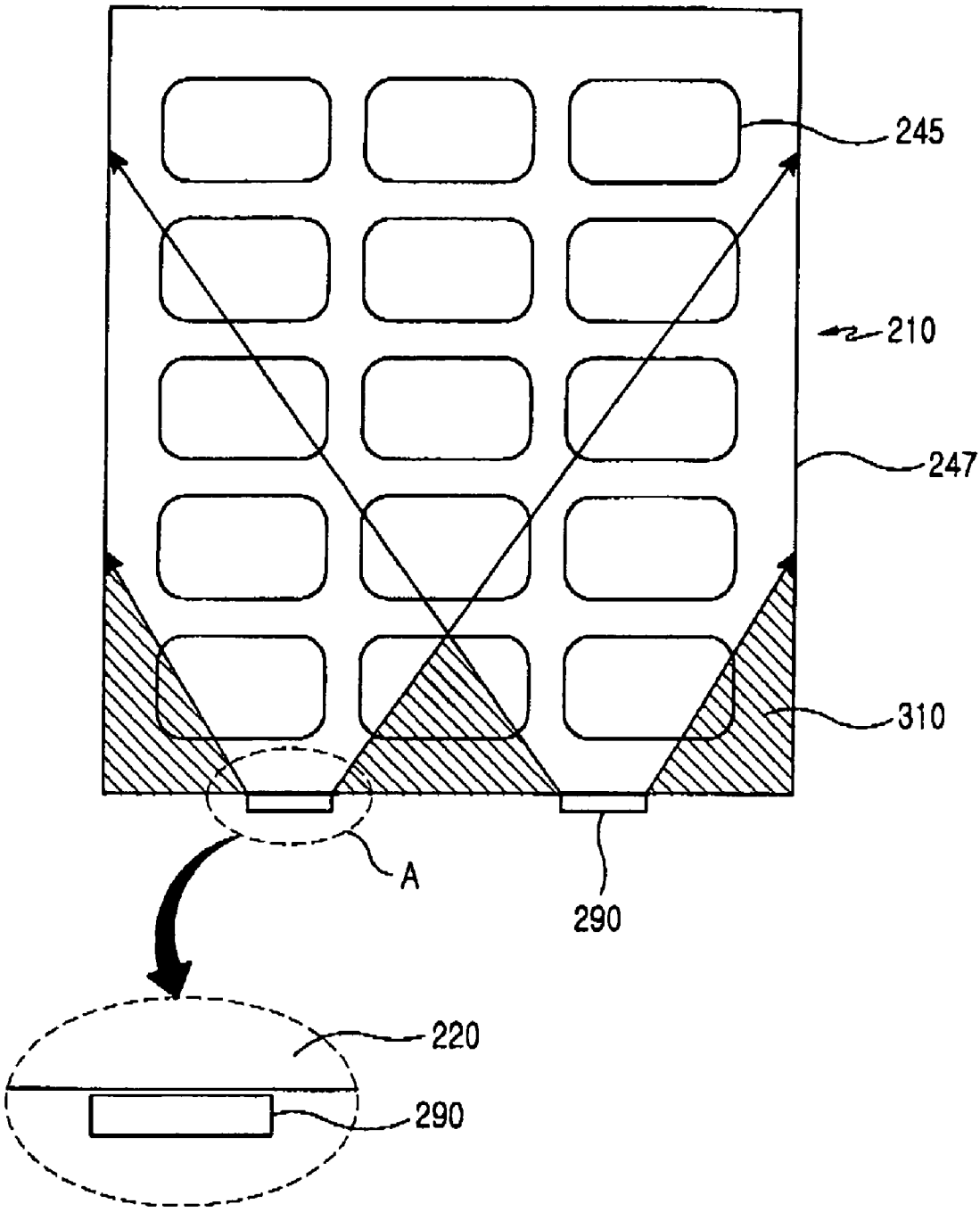
FIG. 5 is a top view showing an example for comparison with the second embodiment of the present invention.

FIG. 4 is a top view briefly showing a part of a keypad assembly according to a second embodiment of the present invention, and FIG. 5 is a top view showing a comparison illustration showing the advantages of the second embodiment of the present invention. The keypad assembly has a construction similar to that of the keypad assembly shown in FIG. 2, except that it has a diffusion member 330 on the lateral surface of the light guide panel 220'. Therefore, the same components are given the same reference numerals and repeated description thereof will be omitted to avoid redundancy.

In FIG. 5, the film 247 has been removed from the magnified part A (enclosed by broken lines) to assist in better understanding of the present invention. As shown, light emerging from the light emitting devices 290 is coupled to the interior of the light guide panel 220 via the lateral surface thereof. Each light emitting device 290 has a predetermined emission angle, which creates shaded regions 310, where no light reaches, on both sides of each light emitting device 290.

Referring back to FIG. 4, the film 247 has been removed from the magnified part B (enclosed by broken lines) in order to aid understanding of the present invention. As shown, the light guide panel 220' has a serrated diffusion member 330 positioned on the lateral surface thereof. The diffusion member 330 has a prism array structure and faces the light emitting devices 290. Hence, light incident on the diffusion member 330 from each light emitting device 290 is diffused by the diffusion member 330 and results in the same effect as that of a widening emission angle of the light emitting device 290. As a result, the shaded regions 320 on both sides of each light emitting device 290 are substantially reduced. The diffusion member 330 makes it possible to obtain more uniform luminance of the entire keypad 210' while minimizing the shaded regions 320, even when the light emitting devices 290 are positioned closer to the lateral surface of the light emitting panel 220'.

As mentioned above, the keypad and keypad assembly according to the present invention are advantageous in that the elastic light guide panel positioned between the key buttons and the protrusions makes it possible to illuminate the key buttons uniformly and brightly and reduce the number of light emitting devices, power consumption, and manufacture cost.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A keypad comprising:

a light guide panel for propagating light therethrough;

a film disposed on an upper surface of the light guide panel and having at least one key button disposed on the upper surface thereof;

at least one protrusion formed on a lower surface of the light guide panel and protruding outwardly from the lower surface of the light guide panel, the lower surface that is opposite to the upper surface of the light guide panel; and at least one reflective pattern fixedly positioned with respect to the light guide panel to reflect a part of the light propagating through the interior of the light guide panel towards the key button, wherein the reflective pattern is formed on the lower surface of the light guide panel and around the protrusion.

2. The keypad as claimed in claim 1, wherein the film is made of a transparent elastomer material.

3. The keypad as claimed in claim 2, wherein the film is made of polyurethane or silicone.

4. The keypad as claimed in claim 1, wherein at least one reflective pattern is locally formed on the light guide panel.

5. The keypad as claimed in claim 1, wherein the light guide panel is made of a transparent elastomer material.

6. The keypad as claimed in claim 5, wherein the light guide panel is made of polyurethane or silicone.

7. The keypad as claimed in claim 1, wherein the light guide panel is adapted to return the key button to an original position after operation of the key button.

8. The keypad as claimed in claim 1, wherein the reflective pattern is formed at and around the protrusion.

9. The keypad as claimed in claim 8, wherein the protrusion is formed in one piece with the light guide panel.

10. The keypad as claimed in claim 1, wherein the film is attached to the upper surface of the light guide panel by an adhesion member.

11. The keypad as claimed in claim 10, wherein periphery of the film is attached to the periphery of the light guide panel.

12. The keypad as claimed in claim 11, wherein an air layer is provided between the central portion of the film and the light guide panel.

13. The keypad as claimed in claim 1, wherein the protrusion is formed in one piece with the light guide panel.

14. A keypad assembly comprising:

a keypad having:

light guide panel for propagating light therethrough, a film disposed on an upper surface of the light guide panel with at least one key button provided on the upper surface of the film, at least one protrusion formed on a lower surface of the light guide panel and protruding outwardly from the lower surface of the light guide panel, the lower surface that is opposite to the upper surface of the light guide panel, and at least one reflective pattern locally formed on the light guide panel to reflect a part of the light propagating through the interior of the light guide panel towards the key button; and a switch board having at least one switch formed on its upper surface, which faces the keypad, wherein as the key button is pressed, a portion of the keypad deformed towards the switch board to activate the switch, wherein the reflective pattern is formed on the lower surface of the light guide panel and around the protrusion.

15. The keypad assembly as claimed in claim 14, further comprising at least one light emitting device disposed to face the lateral surface of the light guide panel and adapted to couple light to the interior of the light guide panel.

16. The keypad assembly as claimed in claim 14, wherein the film is made of a transparent elastomer material.

17. The keypad assembly as claimed in claim 16, wherein the film is made of polyurethane or silicone.

18. The keypad assembly as claimed in claim 14, wherein the light guide panel is made of a transparent elastomer material.

19. The keypad assembly as claimed in claim 18, wherein the light guide panel is made of polyurethane or silicone.

20. The keypad assembly as claimed in claim 14, wherein the light guide panel is adapted to return the key button to an original position after operation of the key button.

21. The keypad assembly as claimed in claim 14, further comprising a diffusion member positioned on the lateral surface of the light guide panel, which faces the light emitting device, to diffuse incident light from the light emitting device.

22. The keypad assembly as claimed in claim 14, wherein the film is coupled to the upper surface of the light guide panel by an adhesion member.

23. The keypad assembly as claimed in claim 22, wherein the periphery of the film is coupled to the periphery of the light guide panel.

24. The keypad assembly as claimed in claim 23, wherein an air layer is disposed between the central portion of the film and the light guide panel.

25. A portable terminal comprising:

a switch board having at least one switch positioned on the upper surface thereof;

a keypad having a light guide panel with upper, lower, and lateral surfaces; and at least one light emitting device positioned adjacent to at least one of the lateral surfaces of the light guide panel, wherein the keypad comprises:

a film positioned on the upper surface of the light guide panel and having at least one key button positioned on the upper surface thereof;

at least one protrusion formed on the lower surface of the light guide panel and protruding outwardly from the lower surface of the light guide panel, the lower surface that is opposite to the upper surface of the light guide panel; and at least one reflective pattern locally formed on the light guide panel to reflect a part of light, which propagates through the interior of the light guide panel, towards the key button, wherein the reflective pattern is formed on the lower surface of the light guide panel and around the protrusion.

26. The keypad as claimed in claim 25, wherein the protrusion is formed in one piece with the light guide panel.

* * * * *